US006560988B2

(12) United States Patent
Kimble et al.

(10) Patent No.: US 6,560,988 B2
(45) Date of Patent: May 13, 2003

(54) UNLOADING PRESSURIZED LIQUEFIED NATURAL GAS INTO STANDARD LIQUEFIED NATURAL GAS STORAGE FACILITIES

(75) Inventors: E. Lawrence Kimble, Sugar Land, TX (US); James R. Rigby, Kingwood, TX (US); Ronald R. Bowen, Magnolia, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/198,208

(22) Filed: Jul. 17, 2002

(65) Prior Publication Data

US 2003/0014981 A1 Jan. 23, 2003

Related U.S. Application Data

(60) Provisional application No. 60/306,986, filed on Jul. 20, 2001.

(51) Int. Cl.[7] ..... F25J 3/00

(52) U.S. Cl. ..... 62/619; 62/50.2

(58) Field of Search ..... 62/50.1, 50.2, 62/50.5, 619

(56) References Cited

U.S. PATENT DOCUMENTS

| | | | | |
|---|---|---|---|---|
| 5,588,307 | A | 12/1996 | Schmidt | 62/614 |
| 5,956,971 | A | 9/1999 | Cole et al. | 62/623 |
| 6,016,665 | A | 1/2000 | Cole et al. | 62/612 |
| 6,023,942 | A | 2/2000 | Thomas et al. | 62/613 |
| 6,070,429 | A | 6/2000 | Low et al. | 62/612 |
| 6,085,528 | A | 7/2000 | Woodall et al. | 62/45.1 |
| 6,089,028 | A | 7/2000 | Bowen et al. | 62/50.2 |
| 6,112,528 | A | 9/2000 | Rigby | 62/48.1 |
| 6,116,031 | A | 9/2000 | Minta et al. | 62/50.2 |
| 6,192,705 | B1 | 2/2001 | Kimble, III | 62/613 |
| 6,199,403 | B1 | 3/2001 | Cole et al. | 62/613 |
| 6,202,707 | B1 | 3/2001 | Woodall et al. | 141/1 |
| 6,223,557 | B1 | 5/2001 | Cole | 62/613 |
| 6,237,347 | B1 | 5/2001 | Rigby et al. | 62/48.1 |
| 6,237,364 | B1 | 5/2001 | Stone | 62/613 |
| 6,250,105 | B1 | 6/2001 | Kimble | 62/613 |
| 6,257,017 | B1 | 7/2001 | Kimble | 62/611 |

FOREIGN PATENT DOCUMENTS

WO WO 00/57102 9/2000

*Primary Examiner*—Ronald Capossela
(74) *Attorney, Agent, or Firm*—Marcy Hoafling

(57) ABSTRACT

Systems and methods are provided for delivering pressurized liquefied natural gas to an import terminal equipped with containers and vaporization facilities suitable for conventional LNG.

4 Claims, 1 Drawing Sheet

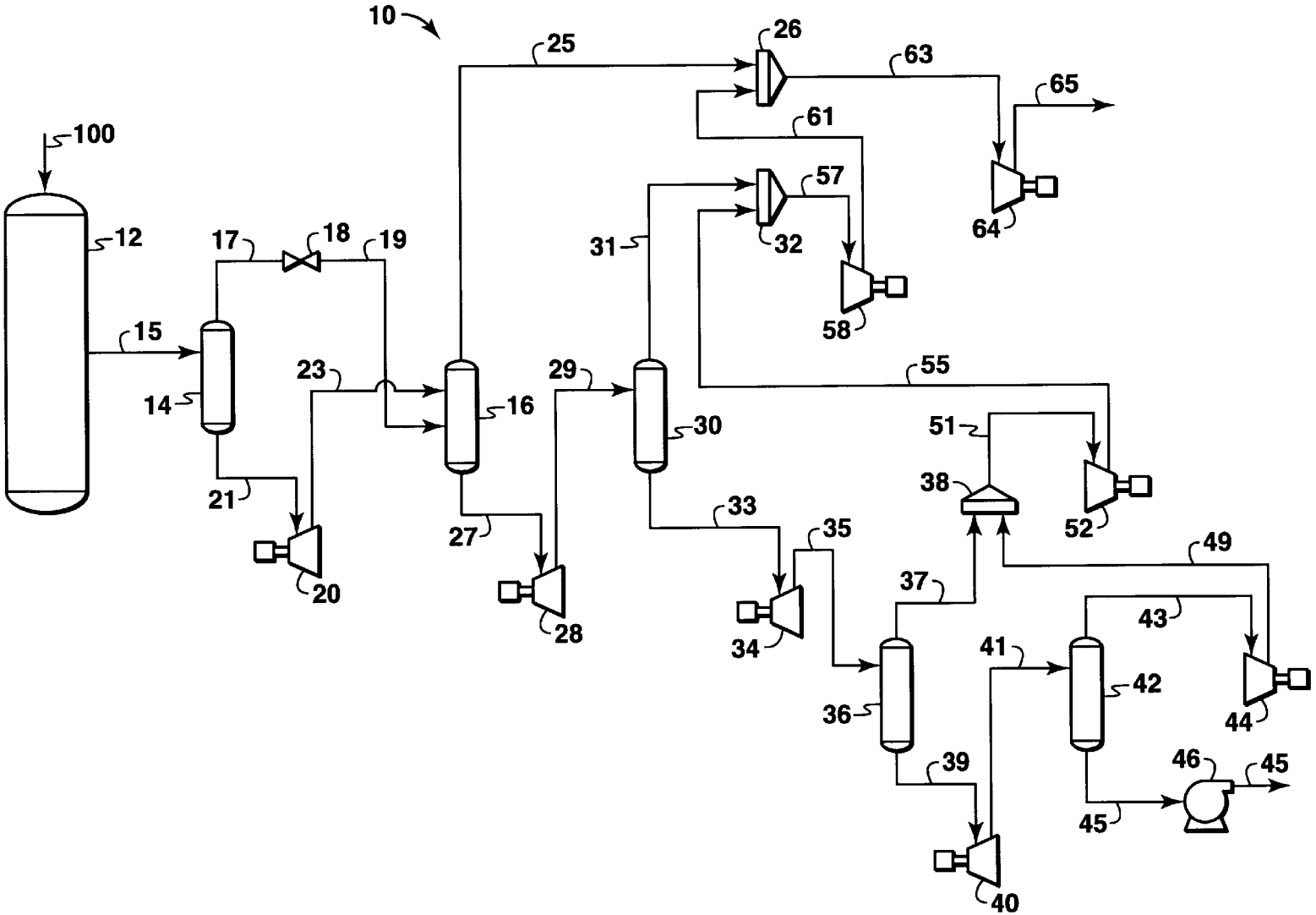
10
100
12
15
14
17
18
19
21
23
20
25
16
27
28
29
30
31
26
61
57
32
58
63
65
64
55
51
52
38
33
35
34
37
36
39
40
41
42
43
44
49
45
46
45

UNLOADING PRESSURIZED LIQUEFIED NATURAL GAS INTO STANDARD LIQUEFIED NATURAL GAS STORAGE FACILITIES

This application claims the benefit of U.S. Provisional Application No. 60/306,986, filed Jul. 20, 2001.

FIELD OF THE INVENTION

This invention relates to systems and methods for delivering pressurized liquefied natural gas to an import terminal that contains storage tanks and vaporization facilities suitable for conventional liquefied natural gas at atmospheric pressure. The pressurized liquefied natural gas cargo, or any fraction thereof, is converted into conventional liquefied natural gas and sent to storage tanks suitable for conventional liquefied natural gas. Any of the cargo not converted to conventional liquefied natural gas can be compressed and warmed to pipeline specifications. This gas can then pass into a sendout pipeline.

BACKGROUND OF THE INVENTION

Various terms are defined in the following specification. For convenience, a Glossary of terms is provided herein, immediately preceding the claims.

Large volumes of natural gas (i.e. primarily methane) are produced in remote areas of the world. This gas has significant value if it can be economically transported to market. Where the production area is in reasonable proximity to a market and the terrain between the two locations permits, the gas is typically transported through submerged and/or land-based pipelines. However, when gas is produced in locations where laying a pipeline is infeasible or economically prohibitive, other techniques must be used for getting this gas to market.

A commonly used technique for non-pipeline transport of gas involves liquefying the gas at or near the production site and then transporting the liquefied natural gas to market in specially-designed storage tanks aboard transport vessels. The natural gas is cooled and condensed to a liquid state to produce liquefied natural gas at substantially atmospheric pressure and at temperatures of about −162° C. (−260° F.) ("LNG"), thereby significantly increasing the amount of gas which can be stored in a particular storage tank. Once an LNG transport vessel reaches its destination, the LNG is typically off-loaded into other storage tanks from which the LNG can then be revaporized as needed and transported as a gas to end users through pipelines or the like.

U.S. Pat. No. 6,085,528 (the "PLNG Patent"), having corresponding International Publication Number WO 98/59085, and entitled "Improved System for Processing, Storing, and Transporting Liquefied Natural Gas", describes containers and transportation vessels for storage and marine transportation of pressurized liquefied natural gas (PLNG) at a pressure in the broad range of about 1035 kPa (150 psia) to about 7590 kPa (1100 psia) and at a temperature in the broad range of about −123° C. (−190° F.) to about −62° C. (−80° F.). Containers described in the PLNG Patent are constructed from ultra-high strength, low alloy steels containing less than 9 wt % nickel and having tensile strengths greater than 830 MPa (120 ksi) and adequate toughness for containing PLNG. U.S. patent application Ser. No. 09/495,831 (the "PLNG Patent Application"), having corresponding International Publication Number WO 00/57102, and entitled "Improved System and Methods for Producing and Storing Liquefied Natural Gas", also describes containers for storage and transport of PLNG. Containers described in the PLNG Patent Application comprise a load-bearing vessel made from a composite material and a substantially impermeable, non-load-bearing liner in contact with the vessel. Any container suitable for storing PLNG shall be referred to hereinafter as a PLNG Container. Any container suitable for storing LNG that is not also suitable for storing PLNG shall be referred to hereinafter as an LNG Container. The PLNG Patent and the PLNG Patent Application are hereby incorporated herein by reference.

PLNG may be unloaded at an import terminal into pressurized PLNG Containers, e.g., by using some of the displaced vapors to maintain a minimum required pressure in the PLNG Containers on the transport ship. However, it may be desirable to deliver PLNG to a conventional LNG import terminal that is equipped with conventional LNG Containers but is not equipped with PLNG Containers In spite of the aforementioned advances in technology, to our knowledge, systems and methods for delivering PLNG to an import terminal equipped with LNG Containers and vaporization facilities suitable for LNG, do not currently exist. It would be advantageous to have such systems and methods.

Therefore, an object of this invention is to provide such systems and methods. Other objects of this invention will be made apparent by the following description of the invention.

SUMMARY OF THE INVENTION

Consistent with the above-stated objects of the present invention, systems and methods for delivering PLNG to an import terminal equipped with LNG Containers and vaporization facilities suitable for LNG are provided. A system according to the present invention comprises: (a) pressurized liquefied natural gas at a pressure of about 1035 kPa (150 psia) to about 7590 kPa (1100 psia) and at a temperature of about −123° C. (−190° F.) to about −62° C. (−80° F.) stored in one or more PLNG Containers having adequate strength and toughness to contain said pressurized liquefied natural gas at said pressure and temperature conditions; (b) one or more LNG Containers suitable for storing liquefied natural gas at substantially atmospheric pressure and at a temperature of about −162° C. (−260° F.); (c) means for removing and reducing the pressure of at least a portion of said pressurized liquefied natural gas from said one or more PLNG Containers, which removed pressurized liquefied natural gas comprises a substantially gaseous portion and a substantially liquid portion; (d) separation equipment suitable for separating said substantially gaseous portion and said substantially-liquid portion; (e) pressurization equipment suitable for pressurizing said substantially gaseous portion to a desired pressure; (f) gas delivery equipment suitable for delivering said pressurized substantially gaseous portion to a gaseous portion destination; (g) depressurization equipment suitable for reducing the pressure of said substantially liquid portion to substantially atmospheric pressure in one or more steps; and (h) liquid delivery equipment suitable for delivering said substantially atmospheric pressure liquid portion to said one or more LNG Containers. In one embodiment, the means for reducing the pressure of at least a portion of the pressurized liquefied natural gas consists essentially of expansion. A method according to the present invention comprises the steps: (a) storing pressurized liquefied natural gas at a pressure of about 1035 kPa (150 psia) to about 7590 kPa (1100 psia) and at a temperature of about −123° C. (−190° F.) to about −62° C. (−80° F.) in one or more PLNG Containers having adequate strength and toughness to contain said pressurized liquefied natural gas at said pressure and temperature conditions; (b) removing and reducing the pressure of at least a portion of said pressurized liquefied natural gas from said one or more PLNG Containers, which removed pressurized liquefied natural gas comprises a substantially gaseous portion and a substantially liquid portion; (c) separating said substantially gaseous portion and said substantially liquid portion; (d) pressurizing said substantially gaseous portion to a desired pressure; (e) delivering said pressurized substantially gaseous portion to a gaseous portion destination; (f) reducing the pressure of said substantially liquid portion to substantially atmospheric pressure in one or more steps; and (g) delivering said substantially atmospheric pressure liquid portion to one or more LNG Containers suitable for storing liquefied natural gas at substantially atmospheric pressure and at a temperature of about −162° C. (−260° F.). In the process of removing PLNG from said PLNG Containers, displacement vapor may be used to maintain pressure and prevent auto-refrigeration of the remaining cargo. In one embodiment, reducing the pressure of at least a portion of the pressurized liquefied natural gas consists essentially of expanding the pressurized liquefied natural gas.

All of, or a portion of, the PLNG is let down through one or more liquid expanders and/or control valve, such as Joule-Thompson valves, in series to the LNG Containers. Resulting flash vapors are collected from flash vessels downstream of the expanders and control valves and fed to a compression system designed to recompress the vapors to pipeline delivery pressure. Displacement vapors for unloading the PLNG Containers on the transport ship can be withdrawn, as needed, from the vapors being recompressed to the sales gas pipeline.

In one embodiment, the predominantly isenthalpic and/or isentropic expansion and partial vaporization of the pressurized cryogenic liquid streams can provide substantially all the refrigeration needed for cooling the remaining (unvaporized) liquid. The end result is a conventional LNG product that has been cooled to its bubble point temperature at essentially atmospheric pressure. This liquid can then be stored in existing conventional LNG import terminal facilities, including LNG Containers, and eventually revaporized for use. If only a portion of the PLNG is let down in pressure, the remaining PLNG can be unloaded and vaporized by any available method, for example without limiting this invention, by the methods described in U.S. Pat. No. 6,112,528.

DESCRIPTION OF THE DRAWINGS

The advantages of the present invention will be better understood by referring to the following detailed description and the attached drawing in which:

FIG. 1 is a schematic, flow diagram of a system according to the present invention.

While the invention will be described in connection with its preferred embodiments, it will be understood that the invention is not limited thereto. On the contrary, the invention is intended to cover all alternatives, modifications, and equivalents which may be included within the spirit and scope of the present disclosure, as defined by the appended claims.

DETAILED DESCRIPTION OF THE INVENTION

Stored PLNG is pressurized out of a PLNG Container and depressurized through one or more depressurization stages in series to substantially atmospheric pressure, using a combination of liquid expanders and/or Joule-Thompson control valves, to produce conventional LNG. Vapors associated with the pressure letdown are recovered from separator vessels and compressed to sales gas pressure. A portion of the vapors can be used to displace PLNG being unloaded from PLNG Containers on the transport ship, if needed.

The LNG resulting from the multistage letdown process is sent to conventional LNG Containers. Subsequently, this LNG can be pumped up to sales gas pressure and vaporized in any type of conventional LNG vaporizer for delivery to the sales gas pipeline.

An example of a system 10 in accordance with this invention is illustrated by FIG. 1. This invention is not limited to the example presented. Optimum system process arrangement will vary with gas composition and site specific economics. Many variations not specifically discussed herein, e.g., a system with only one stage, are considered within the scope of this invention. In this non-limiting example, PLNG having a standard regasified equivalent of 939 K std $m^3$/hr (800 MSCFD) is being unloaded from PLNG Container 12 onboard a transport ship (not shown). The PLNG cargo is let down to conventional LNG storage pressure, i.e., substantially atmospheric pressure. In this example, approximately half of the stream is converted to LNG and stored in conventional LNG Containers. The other half is recovered as flash gas and compressed to sales.

In somewhat greater detail, PLNG feed product at about 30.4 bar (441 psia) and about −96° C. (−140° F.) is unloaded from PLNG Container 12 at a standard regasified equivalent rate of about 939 K std $m^3$/hr (800 MSCFD) into liquid accumulator 14 through line 15. Pressure is maintained in PLNG Container 12 by vapors entering through line 100. These vapors can be obtained by taking a slipstream from the process or from any other acceptable source, as will be familiar to those skilled in the art. In this embodiment, the vapors volumetrically replace the PLNG in PLNG Container 12. Liquid accumulator 14 provides a substantially stable feed rate to the rest of the process. Any vapors or gaseous feed product (an insignificant volume) at about 30.4 bar (441 psia) and about −96° C. (−140° F.) separates from liquid feed product within liquid accumulator 14 and flows through first valve 18 via line 17. Any gaseous PLNG present exits first valve 18 at about 21.0 bar (305 psia) and −107° C. (−160° F.) and flows through line 19 to a first depressurization flash tank 16. Liquid PLNG at about 30.4 bar (441 psia) and about −96° C. (−140° F.) flows from liquid accumulator 14 through line 21 to a first turboexpander 20 at a rate of about 643,500 kg/hr (1,419,000 lb/hr). First turboexpander 20 generates about 668 kW (895 horsepower) of recoverable energy while liquid and gaseous feed product exit first turboexpander 20 at about 20.7 bar (300 psia) and about −107° C. (−160° F.) at a rate of about 643,500 kg/hr (1,419,500 lb/hr) and flow to first depressurization flash tank 16 through line 23. Gaseous feed product at about 20.7 bar (300 psia) and about −107° C. (−160° F.) at a rate of about 163.2 K std $m^3$/hr (138.6 MSCFD) flows out of first depressurization flash tank 16 to a first mixer 26 through line 25.

Liquid PLNG at about 20.7 bar (300 psia) and about −107° C. (−160° F.) flows out of first depressurization flash tank 16 through line 27 to a second turboexpander 28 at a rate of about 532,390 kg/hr (1,173,700 lb/hr). Second turboexpander 28 generates about 755 kW (1012 horsepower) of recoverable energy while liquid and gaseous feed product exit second turboexpander 28 at about 10.3 bar (150 psia) and about −123° C. (−190° F.) at a rate of about 532,390 kg/hr (1,173,700 lb/hr) and flow to second depressurization flash tank 30 through line 29. Gaseous feed product at about 10.3 bar (150 psia) and about −123° C. (−190° F.) at a rate of about 136 K std $m^3$/hr (115.5 MSCFD) flows out of second depressurization flash tank 30 to a second mixer 32 through line 31.

Liquid PLNG at about 10.3 bar (150 psia) and about −123° C. (−190° F.) flows out of second depressurization flash tank 30 through line 33 to a third turboexpander 34 at a rate of about 493,800 kg/hr (969,700 lb/hr). Third turboexpander 34 generates about 794 kW (1064 horsepower) of recoverable energy while liquid and gaseous feed product exit third turboexpander 34 at about 3.1 bar (45 psia) and about −145° C. (−230° F.) at a rate of about 439,800 kg/hr (969,700 lb/hr) and flow to third depressurization flash tank 36 through line 35. Gaseous feed product at about 3.1 bar (45 psia) and about −145° C. (−230° F.) at a rate of about 109.1 K std $m^3$/hr (92.6 MSCFD) flows out of third depressurization flash tank 36 to a third mixer 38 through line 37.

Liquid feed product at about 3.1 bar (45 psia) and about −145° C. (−230° F.) flows out of third depressurization flash tank 36 through line 39 to a fourth turboexpander 40 at a rate of about 365,700 kg/hr (806,200 lb/hr). Fourth turboexpander 40 generates about 301 kW (404 horsepower) of recoverable energy while liquid and gaseous feed product exit fourth turboexpander 40 at substantially atmospheric pressure and about −162° C. (−260° F.), i.e., as LNG, at a rate of about 365,700 kg/hr (806,200 lb/hr) and flow to fourth depressurization flash tank 42 through line 41. About 328,600 kg/hr (724,400 lb/hr) of LNG is pumped out of fourth depressurization flash tank 42 by pump 46 through line 45 to LNG Containers (not shown).

Gaseous feed product at substantially atmospheric pressure and about −162° C. (−260° F.) at a rate of about 54.7 K std $m^3$/hr (46.4 MSCFD) flows out of fourth depressurization flash tank 42 to a first compressor 44 through line 43. Gaseous feed product exits first compressor 44 at about 3.5 bar (50 psia) and about −110° C. (−167° F.) at a rate of about 54.7 K std $m^3$/hr (46.4 MSCFD) and flows through line 49 to third mixer 38 where it is mixed with gaseous feed product at about 3.1 bar (45 psia) and about −145° C. (−230° F.) at a rate of about 109.1 K std $m^3$/hr (92.6 MSCFD) from third depressurization flash tank 36.

Gaseous feed product flows out of third mixer 38 at about 3.1 bar (45 psia) and about −134° C. (−210° F.) at a rate of about 163.7 K std $m^3$/hr (139 MSCFD) to a second compressor 52 through line 51. Gaseous feed product exits second compressor 52 at about 11.0 bar (160 psia) and about −64° C. (−84° F.) at a rate of about 163.7 K std $m^3$/hr (139 MSCFD) and flows through line 55 to second mixer 32 where it is mixed with gaseous feed product at about 10.3 bar (150 psia) and about −123° C. (−190° F.) at a rate of about 136 K std $m^3$/hr (115.5 MSCFD) from second depressurization flash tank 30.

Gaseous feed product flows out of second mixer 32 at about 10.3 bar (150 psia) and about −92° C. (−134° F.) at a rate of about 299.8 K std $m^3$/hr (254.5 MSCFD) to a third compressor 58 through line 57. Gaseous feed product exits third compressor 58 at about 21.7 bar (315 psia) and about −43° C. (−45° F.) at a rate of about 299.8 K std $m^3$/hr (254.5 MSCFD) and flows through line 61 to first mixer 26 where it is mixed with gaseous feed product at about 20.7 bar (300 psia) and about −107° C. (−160° F.) at a rate of about 163.2 K std $m^3$/hr (138.6 MSCFD) from first depressurization flash tank 16.

Gaseous feed product flows out of first mixer 26 at about 20.7 bar (300 psia) and about −67° C. (−89° F.) at a rate of about 462.9 K std $m^3$/hr (393.1 MSCFD) to a fourth compressor 64 through line 63. Gaseous feed product exits fourth compressor 64 at about 69.0 bar (1000 psia) and about 23° C. (74° F.) at a rate of about 462.9 K std $m^3$/hr (393.1 MSCFD) and flows through line 65 to sales.

In one embodiment, at least a part of the refrigeration for cooling is provided by expansion and partial vaporization of the pressurized cryogenic liquid streams. Advantageously, in one embodiment, substantially all of the refrigeration for cooling is provided by expansion and partial vaporization of the pressurized cryogenic liquid streams, without the need for refrigeration equipment that must be powered.

Various options are available with this invention. For example, without limiting this invention: (a) Conventional LNG reserve storage volumes can be maintained at any level desired while the LNG is pumped through to sales; (b) Power recovered from the liquid expanders (e.g., turboexpanders) can be used to generate electric power, or alternatively used directly to offset compression requirements; (c) Cryogenic vapors generated by depressurization of the PLNG can be fed directly to non-lube compressors containing alloy steels capable of processing the cryogenic temperatures involved, e.g., for minimizing horsepower requirements; (d) Cryogenic vapors generated by depressurization of the PLNG can be cross-exchanged to recover the refrigeration and preheat the compressor suction vapors to temperatures acceptable for commercial carbon steel alloys, if desired; (d) Joule-Thompson valves can be substituted at any point for turboexpanders to reduce the cost of the facilities, at the sacrifice of energy recovery and increasing the volume of vapor generated in the depressurization sequence.

Particular advantages of the present invention are that the feeding of cryogenic vapors directly to special alloy, non-lubricated compressors minimizes horsepower requirements for the compressor to sales. In addition, coupling the turboexpanders with the PLNG letdown allows for recovery of energy, e.g., for generation of electrical power, and for minimizing the volumes of vapor generated.

While the present invention has been described in terms of one or more preferred embodiments, it is to be understood that other modifications may be made without departing from the scope of the invention, which is set forth in the claims below.

GLOSSARY OF TERMS bar: a unit of pressure equal to 105 newtons per square meter;

cryogenic temperature: any temperature of about −40° C. (−40° F.) and lower;

kg/hr: kilograms per hour lb/hr: pounds per hour

LNG: liquefied natural gas at substantially atmospheric pressure and at temperatures of about −162° C. (−260° F.);

K std $m^3$/hr: thousand standard cubic meters per hour;

kW: kilowatts, i.e., thousands of watts;

LNG Container: any container suitable for storing LNG that is not also suitable for storing PLNG;

MSCFD: million standard cubic feet per day;

PLNG: pressurized liquefied natural gas;

PLNG Container: any container suitable for storing PLNG;

We claim:

1. A system comprising:

(a) pressurized liquefied natural gas at a pressure of about 1035 kPa (150 psia) to about 7590 kPa (1100 psia) and at a temperature of about −123° C. (−190° F.) to about −62° C. (−80° F.) stored in one or more PLNG Containers having adequate strength and toughness to contain said pressurized liquefied natural gas at said pressure and temperature conditions;

(b) one or more LNG Containers suitable for storing liquefied natural gas at substantially atmospheric pressure and at a temperature of about −162° C. (−260° F.);

(c) means for removing and reducing the pressure of at least a portion of said pressurized liquefied natural gas from said one or more PLNG Containers, which removed pressurized liquefied natural gas comprises a substantially gaseous portion and a substantially liquid portion;

(d) separation equipment suitable for separating said substantially gaseous portion and said substantially liquid portion;

(e) pressurization equipment suitable for pressurizing said substantially gaseous portion to a desired pressure;

(f) gas delivery equipment suitable for delivering said pressurized substantially gaseous portion to a gaseous portion destination;

(g) depressurization equipment suitable for reducing the pressure of said substantially liquid portion to substantially atmospheric pressure in one or more steps; and (h) liquid delivery equipment suitable for delivering said substantially atmospheric pressure liquid portion to said one or more LNG Containers.

2. The system of claim 1, wherein said means for reducing the pressure of at least a portion of said pressurized liquefied natural gas consists essentially of expansion.

3. A method comprising:

(a) storing pressurized liquefied natural gas at a pressure of about 1035 kPa (150 psia) to about 7590 kPa (1100 psia) and at a temperature of about −123° C. (−190° F.) to about −62° C. (−80° F.) in one or more PLNG Containers having adequate strength and toughness to contain said pressurized liquefied natural gas at said pressure and temperature conditions;

(b) removing and reducing the pressure of at least a portion of said pressurized liquefied natural gas from said one or more PLNG Containers, which removed pressurized liquefied natural gas comprises a substantially gaseous portion and a substantially liquid portion;

(c) separating said substantially gaseous portion and said substantially liquid portion;

(d) pressurizing said substantially gaseous portion to a desired pressure;

(e) delivering said pressurized substantially gaseous portion to a gaseous portion destination;

(f) reducing the pressure of said substantially liquid portion to substantially atmospheric pressure in one or more steps; and (g) delivering said substantially atmospheric pressure liquid portion to one or more LNG Containers suitable for storing liquefied natural gas at substantially atmospheric pressure and at a temperature of about −162° C. (−260° F.).

4. The method of claim 3, wherein said reducing the pressure of at least a portion of said pressurized liquefied natural gas consists essentially of expanding said pressurized liquefied natural gas.

* * * * *